United States Patent [19]

Turner

[11] 4,060,060

[45] Nov. 29, 1977

[54] VALVING SYSTEM FOR COMPRESSORS, ENGINES AND THE LIKE

[75] Inventor: William F. Turner, Graham, Tex.

[73] Assignee: Turner Research, Inc., Graham, Tex.

[21] Appl. No.: 687,207

[22] Filed: May 17, 1976

[51] Int. Cl.[2] ..... F02B 57/06

[52] U.S. Cl. ..... 123/43 A; 91/476; 91/490; 91/500

[58] Field of Search ..... 123/43 A, 43 AA; 91/474, 476, 479, 490, 500

[56] References Cited

U.S. PATENT DOCUMENTS

| | | | |
|---|---|---|---|
| 1,697,853 | 1/1929 | Coursen | 91/476 X |
| 3,830,208 | 8/1974 | Turner | 123/43 A |

FOREIGN PATENT DOCUMENTS

| | | | |
|---|---|---|---|
| 1,245,323 | 9/1971 | United Kingdom | 91/500 |

*Primary Examiner*—Robert G. Nilson
*Attorney, Agent, or Firm*—James C. Fails

[57] ABSTRACT

An improvement in a rotary vee device that includes relative rotational and reciprocal motion between the interior walls of the cylinder and the exterior walls of the pistons characterized by each piston having first flow areas defined on its periphery and a first fluid flow passageway; each of the first fluid flow passageways in communication with the interior of its respective cylinder above its respective piston and with its respective first flow areas; and each cylinder wall having intake ports and discharge ports located at predetermined locations. The ports are connected with respective passageways for respective intake and discharge flows of a fluid when a respective port is rotatably and reciprocally brought into communication with its flow area on its piston as respective relative rotational and reciprocal motion is effected between respective pistons and cylinders and there is effected a plurality of cycles, each cycle comprising an intake flow followed by closure of an intake port, pressure exerted on said fluid, opening of a discharge port, flow and discharge of a fluid from the interior of the cylinder and closure of the discharge port.

14 Claims, 13 Drawing Figures

Fig. 6
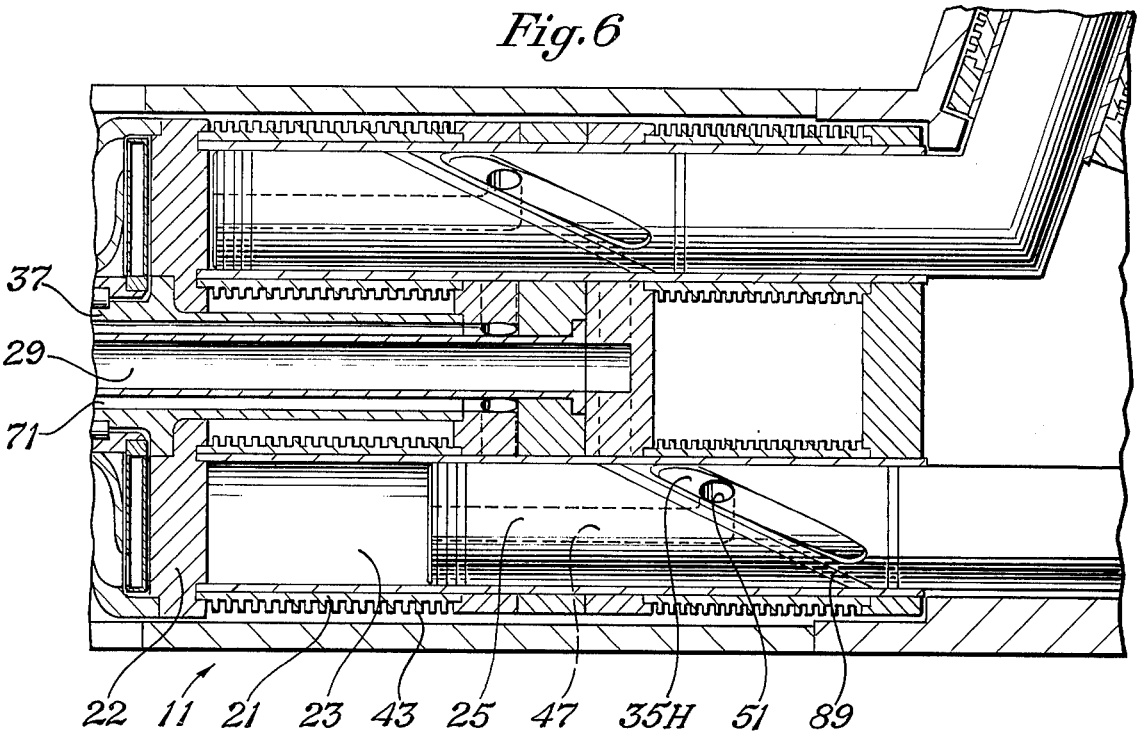
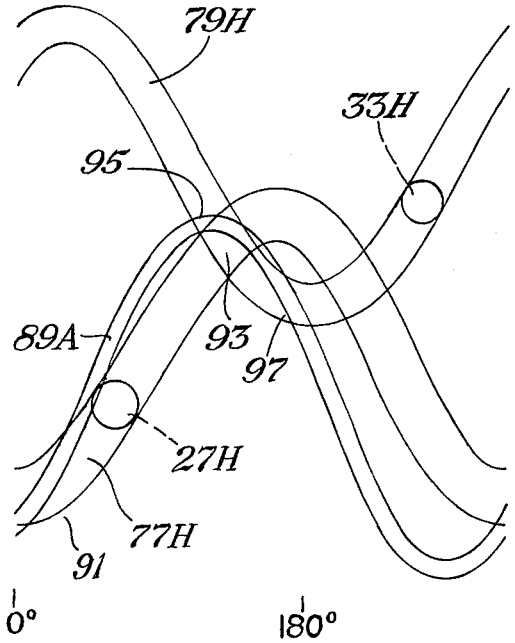
Fig. 7
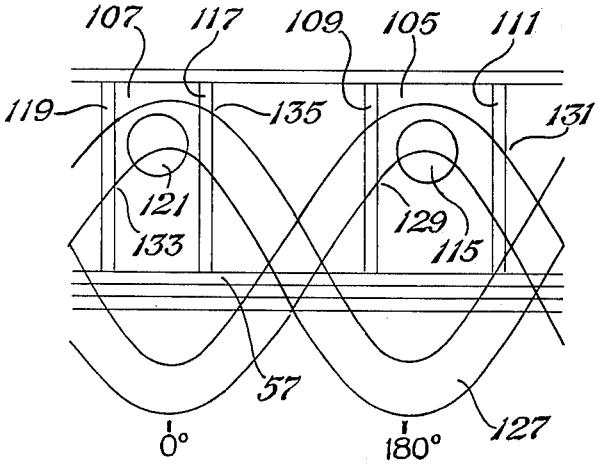
Fig. 9

VALVING SYSTEM FOR COMPRESSORS, ENGINES AND THE LIKE

BACKGROUND OF THE INVENTION

1. Field of the Invention

This invention relates to rotary devices that may be employed as either pumps, including compressors, or engines, including motors. More particularly, this invention relates to an improvement in devices that are known as either rotary vee devices or the so-called angle piston type devices and that may be employed as pumps for pumping or compressing fluids, particularly compressible fluids; or as engines, including motors powered by either compressible or incompressible fluids and engines powered by internal combustion of a fuel.

2. Description of the Prior Art

As delineated in my U.S. Pat. No. 3,830,208, entitled "Vee Engine", a wide variety of devices of the so-called angle piston type have been employed variously as: universal joints for transmitting forces, pumps, compressors, fluid powered motors and rotaty vee engines. In addition to the U.S. patents cited therein, a plurality of patents were cited against that application, including United States, British and French patents. Despite the large number of prior art references, none of the references described apparatus that was completely satisfactory in valving; particularly that had the following desirable features.

1. The device should allow pumping by having a structure whereby a discharge can be opened slightly after bottom dead center.

2. The device should allow compressing a fluid to line pressure before opening to discharge the fluid into the line if employed as a compressor or the like.

3. The device should allow valving to control timing for intake and discharge independently of the relative position of the piston axially of the cylinder. Expressed otherwise, the device should allow valving independently of the axial position of the piston with respect to the cylinder, thereby providing another degree of freedom in design.

4. The device should allow employing centrifugally assisted scavenging as described and claimed in my U.S. Pat. No. 3,905,338, entitled "Vee Engine With Centrifugally Assisted Scavenging"; the descriptive matter of which is embodied therein by reference for details omitted herefrom.

5. The device should allow employing a center section compressor and if employed as an engine, bypass throttling, such as described in my U.S. Pat. No. 3,902,468, entitled "Center Section Compressor", and U.S. application Ser. No. 520,435; the descriptive matter of both being embodied herein by reference for details omitted herefrom.

6. The device should allow opening for discharge of a fluid, later opening for intake, scavenging, closing the discharge and building to supercharge pressures, such as has been unable to be accomplished with conventional two cylce porting.

7. The device should allow flexibility in firing systems that are desired to be employed when employed as an internal combustion engine.

8. The device should allow for being designed as a compressor, as a pump, as a hydraulic motor, as a stream engine, and as an internal combustion engine by suitable locations of intake and discharge ports and with suitable intake and discharge flow passageways and areas as will be described in more detail hereinafter.

9. The device should eliminate the use of cams; cam followers; tappets; valves, per se; and eliminate the initial cost and power required for operation, thereby increasing the efficiency of the device.

10. The device should eliminate the maintenance problems with burned valves in internal combustion engines or with breakage of valves in compressors or the like.

11. The device should not require large diameter seal areas, such as having an entire face of the cylinder block moving against a stationary head plate.

SUMMARY OF THE INVENTION

Accordingly, it is an object of this invention to provide an improved rotary device, or apparatus, having one or more of the foregoing features not heretofore provided.

It is a specific object of this invention to provide an improved rotary device that has improved valving and effects a plurality of the features not heretofore provided.

It is a still more specific object of this invention to provide an improved rotary device that may be operated as a pump, compressor, or engine and achieves a plurality of the respective foregoing features appropriate to the end use of the apparatus.

These and other objects will become apparent from the descriptive matter hereinafter, particularly when taken in conjunction with the drawings.

In accordance with this invention, one or more of the features delineated hereinbefore are provided by an improvement in a rotary vee device that includes a rotational cylinder block and a plurality of pistons disposed within the cylinders in the block such that there is relative rotational and reciprocal motion between the interior walls of the cylinder and the exterior walls of the piston. The improvement comprises the use of respective flow area and communicating passageway on one of pistons and cylinder walls; and of selectively reciprocally and rotationally engageable intake and exhaust ports in the other thereof. For example, the improvement comprises a plurality of respective first flow areas defined on the periphery of respective pistons, at least one to each piston; and a plurality of first fluid flow passageways through the respective pistons, at least one to each piston. Each of the first fluid flow passageways terminate at a first end in communication with the interior of its respective cylinder above its respective piston and at its second end with its respective first fluid flow area disposed on the periphery of its piston. A respective plurality of intake ports and passageways and discharge ports and passageways include aperatures located at predetermined locations in the peripheral interior walls of the cylinders and connected with the respective intake and discharge passageways for the respective intake and discharge flow of a fluid when a respective port is brought into communication with its first flow area on its piston. Both the intake and discharge ports are disposed so that they traverse in communication with a respective flow area on a respective piston at some point during the 360° rotation of the cylinder block and the piston therewithin such that as respective relative rotational and reciprocal motion is effected between respective pistons and cylinders there is effected a plurality of cycles, each cycle comprising an intake flow followed by closure of an intake port, pressurization of the fluid, opening of a discharge port, flow and discharge of a fluid from the interior of the cylinder and closure of the discharge port. The use of the relative rotational motion and selectively positionable flow areas on one of the piston and cylinder walls and the selective intake and discharge ports on the other thereof enable achieving economies in manufacture and operation of the rotary vee device.

A wide variety of embodiments become possible enabling controlling the intake and discharge strokes singly or together depending upon whether the device is being employed as a pump, compressor, two cycle engine, four cycle engine, or motor.

BRIEF DESCRIPTION OF THE DRAWINGS

FIG. 6 is a partial cross sectional view of the pistons and cylinder block of another embodiment of this invention employing a diagonal sealing ring on each piston.

FIG. 7 is an unfolded view, partly schematic, showing a traverse of the respective ports along a piston employing a diagonal ring, such as illustrated in FIG. 6.

FIG. 9 is an unfolded schematic view of an embodiment similar to FIG. 8 having dual ported pistons and the two respective flow areas thereon.

DESCRIPTION OF PREFERRED EMBODIMENTS

Figure 1:
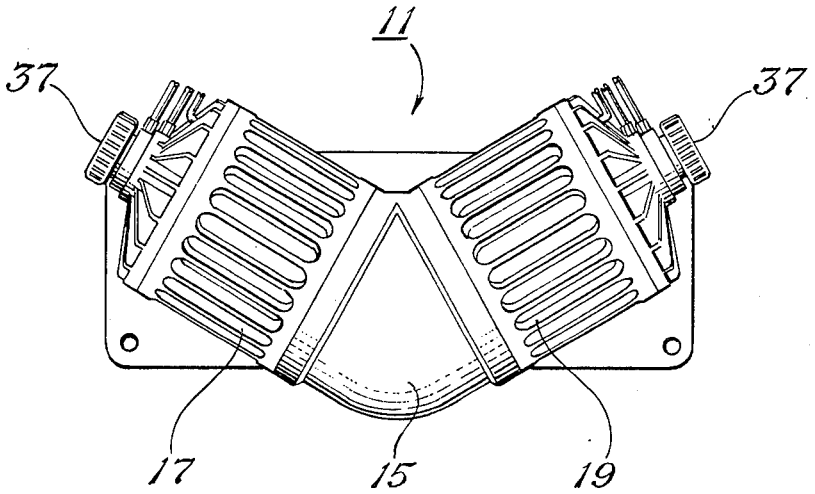
FIG. 1 is a partial side elevational view of a rotary vee, or angle piston, device of one embodiment of this invention.
Figure 2:
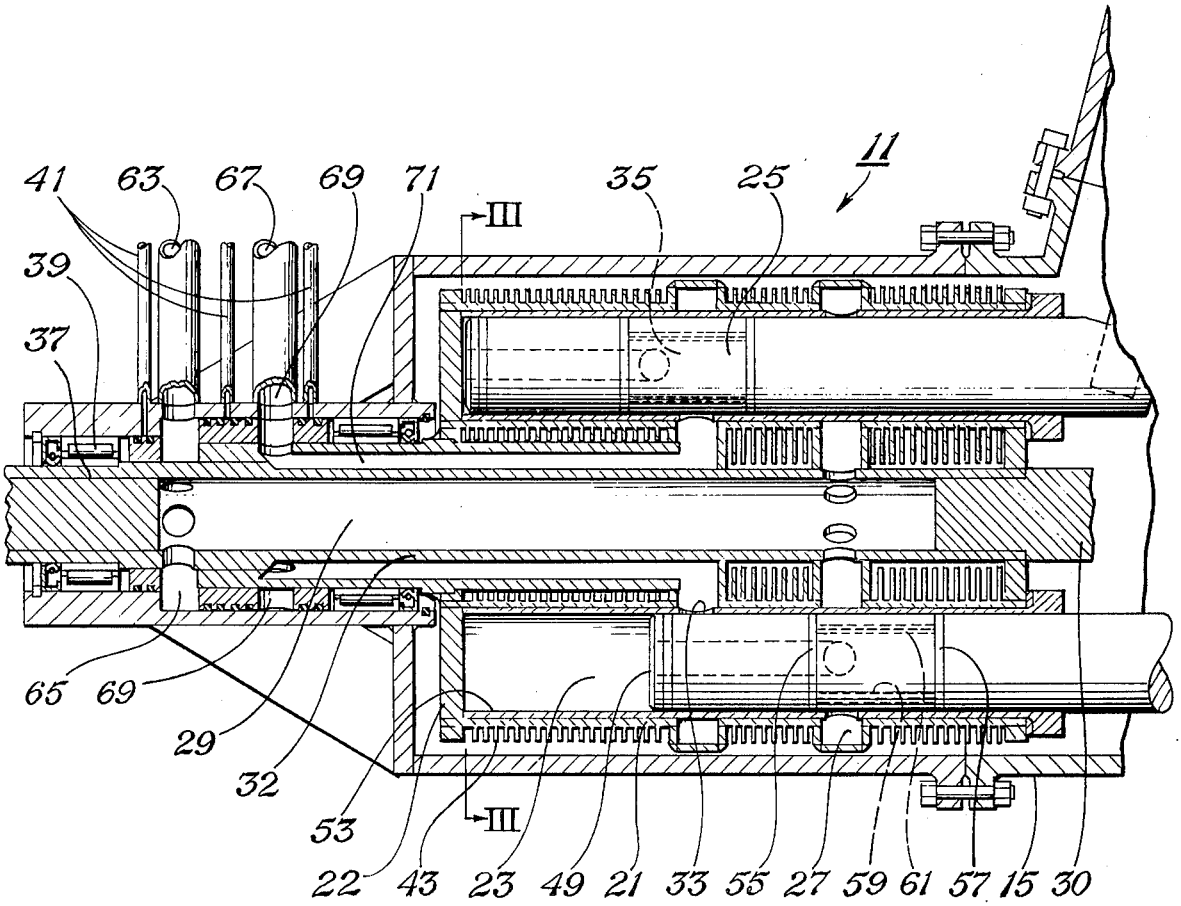
FIG. 2 is a partial cross sectional view of one cylinder block and pistons of an angle piston device similar to that of FIG. 1.

Referring to FIGS. 1 and 2, there is illustrated a rotary vee device 11 similar to the rotary vee engine described in my U.S. Pat. No. 3,830,208. The respective detailed interconnection of elements and operation of the device 11 when employed as an engine is explained in that patent and that descriptive matter is embodied herein by reference for details not duplicated in the brief description hereinafter. The vee device 11 may be employed in any configuration that will accommodate its end use and the delivery of power thereto or therefrom in normal usage. If employed as a motor or an engine, the power may be delivered to transmission or other uses where the power from conventional reciprocating internal combustion engines have been employed. If employed as a pump or a compressor, as illustrated, power may be supplied to it from a prime mover, such as an engine, via conventional power input apparatus, including sprockets, gears, pulleys and belts or the like.

The vee device 11 includes an outer housing 15 having right and left casings 17 and 19. Disposed interiorly of housing 15 are first and second cylinder blocks, such as cylinder block 21, FIG. 2, that are rotatable about their respective central longitudinal axes and have radially spaced parallel cylinders 23. The vee device 11 also has respective first and second cylinder heads, such as cylinder head 22, that are connected respectively with the first and second cylinder blocks and rotatable therewith. If desired, the respective cylinder heads may be integrally connected, or formed, with the cylinder blocks and the cylinders formed by precision boring into the unitary block-head combination. Respective first and second sets of pistons, such as pistons 25, are disposed in the respective cylinders 23 in the cylinder blocks. The pistons reciprocate within their cylinders as the cylinder blocks rotate, simultaneously carrying the pistons in a generally elliptical path. The pistons maintain their same relative top on top position, however. Consequently, there is both relative rotational and reciprocal motion between the exterior walls of the pistons and the interior walls of the cylinders.

A center support 30, that is stationary, carries cylindrical tubular members 32 defining the central intake passageway 29. Fluid communication between the central intake passageway 29 and the interior of each respective cylinder is blocked, however, when the piston 25 moves such that its flow area 35 is no longer in fluid communication with the associated inlet port 27. The piston thus traps the fluid for compression thereof.

Power delivery shafts 37 deliver power to or from the rotating cylinder blocks depending upon the application for the device 11. The power delivery shafts 37 are connected with respective torque input and output means, such as gears (not shown). The shaft 37 is journalled in suitable bearings 39. Oil is supplied via suitable oil lines 41 for lubrication.

Suitable cooling fins 43 are provided for transferring heat from the walls of the cylinders into an air-stream blowing past the fins 43. The air is inherently circulated through the centrifugal motion of the respective finned cylinders. Alternatively, it may be circulated by any suitable means, such as the center section compressor described and claimed in my priorly referenced U.S. Pat. No. 3,902,468.

The device 11, particularly as an engine, has been described in the prior art patents and need not be amplified in detail herein. The priorly described oil circulation system and cooling system are illustrated but not described in detail, since they have been priorly described.

The main thrust of this invention lies in the use of the relative rotational motion between the interior walls of the cylinders and the exterior walls of the pistons to accomplish the valving. To accomplish this, each of the pistons 25 has a flow area 35 recessed in its face to allow fluid flow any time a port 27 or 33 is connected in communication therewith.

The vee device 11 has a plurality of inlet, or intake, ports, such as inlet port 27, for intake of a charge of fluid within the respective cylinders atop the respective pistons therewithin at least by the time each piston has attained a predetermined first position, such as aligning its flow area with the port 27. The nature of the fluid will vary depending upon the application for which the vee device is being employed. If it is employed as a pump, the fluid may be a liquid or a compressible fluid. If the vee device 11 is employed as a compressor or blower, the fluid will ordinarily be a compressible fluid, such as air, natural gas or the like. If the vee device 11 is being employed as an engine, the fluid will be a combustible mixture or a portion thereof. Typically, a combustible mixture is formed by a combination of an oxygen-containing fluid, such as air, and fuel, such as gasoline vapors or natural gas. If the vee device 11 is being employed as a motor, the fluid may be a pressurized fluid having high potential energy therewithin and flowing through the engine to a lower potential energy level. Each inlet port 27 is in fluid communication with its respective cylinder and with a central intake passageway 29, FIGS. 2 and 3. If the vee device 11 is being employed as an engine, it advantageously employs optimum scavenging, as described in my above reference U.S. Pat. No. 3,905,338. Such optimum scavenging is effected by the proper locations of the respective inlet ports 27 and/or exhaust ports 33 and the location and shape of the respective inlet passageways.

Each of the pistons has a first flow passageway 47 that terminates at a first end 49 in communication with the interior of its respective cylinder 23. The first flow passageway 47 also communicates at its second end with its respective first flow area 35, as by a second passageway 51 that tees into the first flow passageway 47.

As illustrated, each of the cylinders 23 has its own respective liner 53 that has mating apertures for the respective intake and discharge ports. If desired, the liners may have their own fluid flow passageways and be replaced for locating the respective inlet and discharge ports 27 and 33 at different locations for independently changing the respective intake and exhaust portions of the cycle, or changing the timing of opening and closing of intake and discharge valveing means.

The first flow area 35 may be defined by any suitable means. As illustrated, it is defined by an upper sealing ring 55, a lower sealing ring 57 and laterally disposed, longitudinally oriented sealing rings 59 and 61. The sealing rings 55 and 57 extend peripherally entirely around the respective pistons on which they are fitted. The longitudinally oriented rings 59 and 61 are suitably affixed to the piston and effect closure where they join with the sealing rings 55 and 57 such that the first flow area is isolated and the enclosing rings sealingly engage both the piston and the cylinder walls. The term "rings" is employed herein in its automotive connotation to designate an element of any shape that seals intermediate adjacent walls of an interior piston and an exterior cylinder.

A suction conduit 63 is connected by annular passageway 65 with the central intake passageway 29 and the inlet port 27. In a similar manner, a discharge conduit 67 is connected via annular passageways 69 and 71 with the discharge port 33.

The descriptive matter hereinafter will be given with respect to operation of the device 11 as a compressor and may be understood by referring to one or more of the FIGS. 1–4. Rotation of the compressor is started by input of torque to induce rotation of the cylinder block 21 and cylinder head 22 by way of shaft 37. As implied hereinbefore, the rotation effects an elliptical movement of the pistons and, hence, the ends of the piston in a plane that is diagonal with respect to the plane of the cylinder heads 22. Consequently, as the cylinder heads rotate (with their contained pistons,) there is reciprocal motion between the piston and the interior of the cylinders in which they are emplaced. The pistons retain their same top-on-top position, so there is also relative rotational motion between the adjacent exterior walls of the piston and the interior walls of the cylinders.

Figure 3:
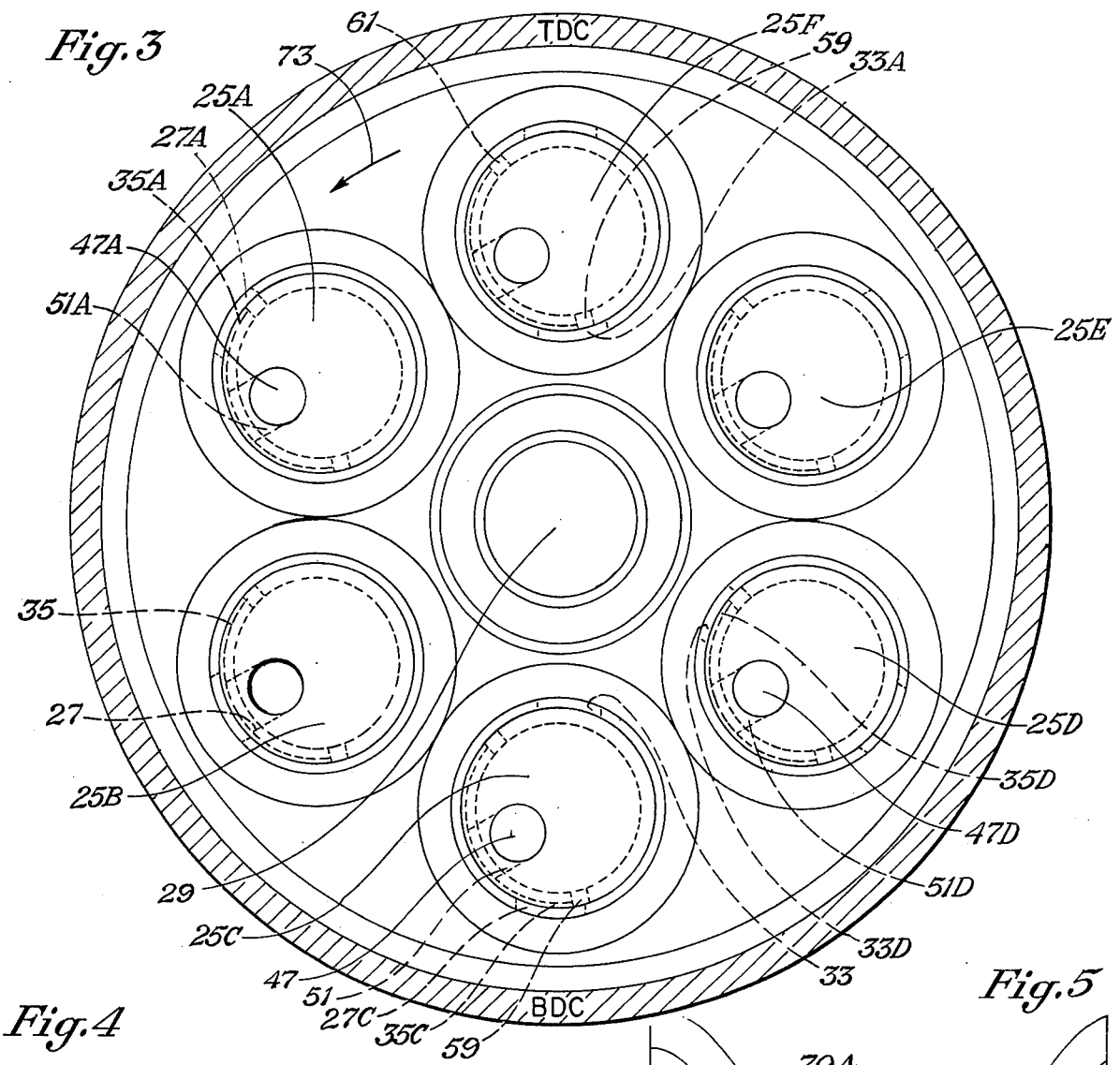
FIG. 3 is a partial end view of the pistons and cylinder block of FIG. 2 taken along the line III—III of FIG. 2.

Referring to FIG. 3, the cylinder block is rotating counterclockwise, as indicated by arrow 73. Thus, as a given piston reaches top dead center position, labeled TDC in FIG. 3, the discharge port 33A is just being closed off to complete the discharge cycle. Further, relative rotation will move the inlet port 27 past the bottom ring 57 and the longitudinal ring 61 and into the flow area 35, starting the intake portion of the cycle. To illustrate, by the time the piston will have reached the next counterclockwise illustrated position, the inlet port 27A will have been opened into fluid communication with the first flow area 35A of the piston 25A for the intake stroke, or intake portion of the cycle. The fluid flows via the second passageway 51A and first flow passageway 47A interiorly of the cylinder above the top of the piston 25A. The suction, or intake, stroke continues as shown as the pistons 25B and 25C, until the bottom dead center position, BDC, is reached. As can be seen in the piston 25C, the inlet port 27C is beginning to be closed off by the longitudinal ring 59 so as to begin to isolate the first flow area 35C from the inlet port 27C. By the time the piston has been moved to the position indicated by the piston 25D; the inlet port 27D will have been closed; the fluid compressed; and, if below the peripheral ring 55, the discharge port 33D will have been opened into fluid communication with the first flow area 35D. Consequently, the compressed fluids interiorly of the cylinder and above the piston will flow via passageways 47D and 51D to the discharge port 33D. From the discharge port, the fluids will be discharged via annular passageways 71, 69 and discharge conduit 67. The discharge stroke continues, as illustrated by the pistons 25E and 25F, to the top dead center position, TDC. As indicated hereinbefore, the discharge port 33A is just being closed off at the top dead center position by the longitudinal ring 59. Thus, from viewing FIG. 3, it can be seen that the placement of the vertical ring 61 can be employed to control the time of opening $t_o$ of each of the inlet ports 27 and the discharge port 33. Also, it is readily apparent that placement of the longitudinal ring 59 controls the time of closing $t_c$ of the respective inlet and discharge ports 27 and 33. It is also readily apparent that the width that the longitudinal rings are spaced apart controls the time $\Delta t$ that one or both of the valves remain open. Less readily apparent from FIG. 3 is that placement of the peripheral sealing rings 55 and 57 also control the time of opening and time of closing independently of the longitudinal rings, as can be seen with respect to FIG. 2. It can be seen that longitudinal placement of the peripheral sealing rings 55 and 57 controls the time at which the respective ports 27 and 33 will have access to any portion of the first flow area 35 therebetween, regardless of where the longitudinal sealing rings 59 and 61 are placed. By similar analogy, the space between the rings 55 and 57 also controls the duration of time $\Delta t$ between the time of opening $t_o$ and time of closing $t_c$, if within the traverse of the ports between the longitudinal sealing rings.

Figure 4:
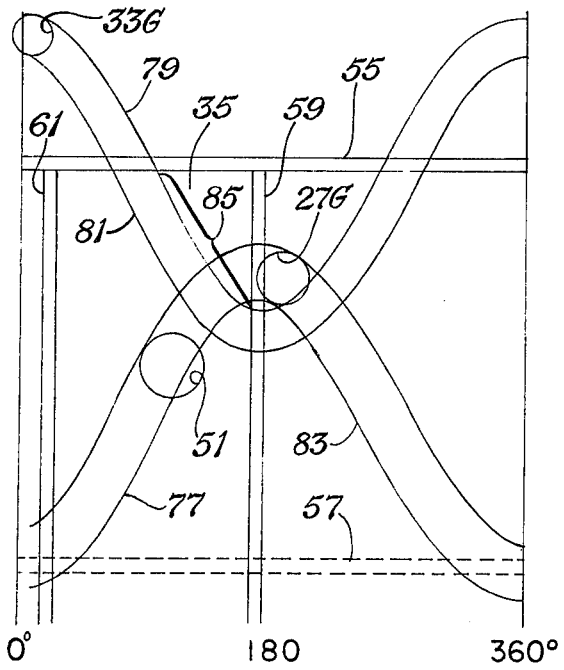
FIG. 4 is an unfolded view, partly schematic, showing the first flow area of a piston similar to those of FIGS. 2 and 3 with the traverses of the intake port and the discharge port superimposed thereupon.
Figure 5:
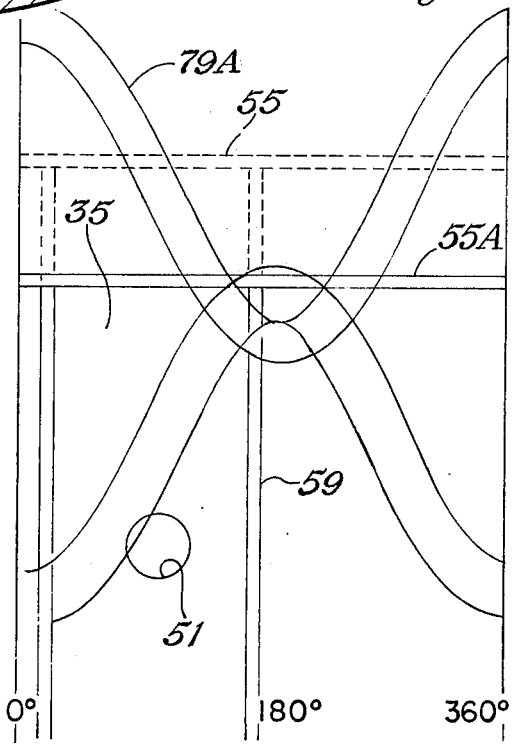
FIG. 5 is an unfolded view, partly schematic, of an embodiment of this invention in which the top ring 55 of the first flow area has been moved downwardly as compared to the embodiment of FIG. 4.

One of the unique advantages of this invention is that the simple expedient of changing the location of the rings allows control of the discharge pressure so that a compressed gas can be discharged at a relatively low pressure or a relatively high pressure. This is illustrated graphically by FIGS. 4 and 5. FIGS. 4 and 5 represent a simplified way of depicting traverses of the respective inlet ports 27 and discharge ports 33 with respect to a flow area 35 on the face of the piston. Specifically, because of the relative reciprocal and rotational motion between the adjacent walls of the piston and cylinder, the respective ports make a "sine curve" traverse with respect to the face of the piston. When unfolded, this can be represented as illustrated in FIG. 4. Therein, the trace 77 illustrates the traverse of the inlet port 27. The trace 79 illustrates the traverse of the discharge port 33. In FIG. 4, the top sealing ring 55 is illustrated, whereas the bottom sealing ring 57 is illustrated only in dashed lines, since it may not be important, depending upon the location of the respective ports. For discussion purposes, the lowest point of traverse of the inlet port 27, occurring at the top dead center position, will arbitrarily be chosen as the 0° position. Thus, it can be seen that at slightly past the 0° position, the inlet port begins to be opened as it moves past the longitudinal sealing ring 61 and above the peripheral sealing ring 57 if the latter is employed. The inlet port thus remains in communication with the first flow area 35 and the second passageway 51 until it passes the second longitudinal sealing ring 59 as it approaches the 180°, or bottom dead center, position. As illustrated in FIG. 2, the exhaust port 33 lags 180° behind the inlet port 27. Consequently, as the inlet port 27G moves past the longitudinal ring 59, the exhaust port 33G moves past the 0° position. It is noteworthy, however, that the discharge stroke, or discharge portion of the cycle, is not commenced; since the discharge port 33G has not moved below the peripheral sealing ring 55. Consequently, the gas is compressed until the relative longitudinal movement of the piston and the discharge port moves it past the ring 55, indicated by a position 81. Of course, the inlet port 27 will have moved a commensurate number of degrees to the position 83, but this is of no significance, since it is sealingly isolated from communication with the flow area 35 and the second passageway 51. The exhaust port 33 remains in communication with the first flow area 35 and the second passageway 51, allowing dischrge of the fluid until it passes the longitudinal sealing ring 59, near the 180° position. As the discharge port 33 passes the 180° position, the inlet port 27 will pass the 0° position so as to begin the cycle over again. It is noteworthy that there is a relatively long period of time, illustrated by the brackets 85, that the discharge port is opened, even though there has been somewhat more compression than with respect to the embodiment described in FIG. 3.

In the embodiment of FIG. 5, however, the top peripheral ring 55A has been lowered in order to discharge only at a high pressure, as for discharging into a high pressure line. Note that the intake characteristics remain substantially the same, since the top ring 55A has not been lowered enough to alter them. The opening of the discharge port 33G, however, is shortened to a very short time interval to allow the highly compressed fluid to be discharged rapidly. Specifically, the discharge port 33, as illustrated by the traverse 79A, is exposed to communication with the first flow area 35 for only a short time. For comparison purposes, the respective longitudinal rings 61 and 59 have been extended upwardly in dashed lines to intersect with the dashed line 55 to illustrate the much longer time that the discharge port would be open if a situation analogous to that illustrated in FIG. 4 were employed. Thus, in the illustrated embodiment, the height of the ring 55 controls the time of opening $t_o$ of the exhaust port 33, whereas the longitudinal ring 59 controls the time of closure of the discharge port. In the embodiments illustrated in FIGS. 4 and 5, it can be seen that radial placement of the longitudinal rings 59 and 61, as well as the axial, or longitudinal, placement of the peripheral rings 55 and 57 can alter the intake and discharge characteristics independently of each other with respect to a given set of intake and discharge ports. Of course, as indicated hereinbefore, the intake and discharge ports, per se, can be located to impart the desired characteristics, as for a pump, compressor, motor or internal combustion engine.

Given the idea of employing the relative reciprocal and rotational motion between the adjacent walls of pistons and enclosing cylinders to effect the valving, a variety of different structures can be designed by those skilled in this art. Illustrative of another embodiment are FIGS. 6–8, with the following descriptive material.

ANOTHER EMBODIMENT

Referring to FIG. 6, the rotary vee device 11 includes the central longitudinal passageway 29, the shaft 37 and the annular discharge passageway 71. The rotary vee device 11 also includes the rotating cylinder blocks 21 and cylinder heads 22 defining the cylinders 23 within which are disposed the pistons 25. Although not illustrated, the rotary vee device 11 employs the conventional bearings, lubrication system, cooling system for flow of a cooling fluid past the fins 43, and the like.

In this embodiment, however, the flow area 35H comprises an area that is undercut in the piston; for example, undercut about 0.100 inch such that fluid flow can flow to the second passageway 51 which communicates with the first flow passageway 47. The respective inlet and exhaust ports are not shown specifically in order that the undercut area can be shown on the face of the respective pistons. The inlet and discharge ports 27 and 33 may be placed as described hereinbefore if desired. For example, suitable annular passageways may communicate respectively between the intake and discharge passageways 29 and 71 and the intake and discharge ports that are located so as to traverse past the diagonal ring 89 and the flow area 35H at respective intervals during respective portions of a cycle of a piston within its cylinder, as illustrated in FIG. 7. In an unfolded view, the diagonal ring will be illustrated as a sine wave line 89A, FIG. 7. The inlet port 27H will make a sine wave traverse, or trace, 77H.

In operation, the rotary vee device 11 is rotated as described hereinbefore. As the inlet port 27H is moved past the diagonal ring 89, as at the first position 91, FIG. 7, it communicates with the flow area 35H, the second passageway 51 and the first flow passageway 47 to begin a suction stroke, or intake portion of a cycle. The suction stroke continues until the inlet port 27 is moved past the diagonal ring 89, as at second position 93. As described hereinbefore, the discharge ports 33H lag about 180° behind the inlet port. Consequently, the gases that are taken in on the suction stroke are thereafter compressed until the discharge port moves past the diagonal ring, as at third position 95. The compressed fluid is thereafter allowed to discharge until the discharge port, or exhaust port, 33H moves to the fourth position 97 at which time it is closed.

Shortly after the discharge port 33H is closed by moving past the diagonal ring 89, shown by moving past the line or the traverse 89A, the suction port 27H again moves past the top dead center position, as at first position 91. The cycle is then repeated. The described cycles occur for each given piston.

It can be readily seen that the foregoing structures can be employed as compressors. By suitable movement of either the first flow area defining means, such as the rings, and the intake and exhaust ports 27 and 33, the apparatus can be readily converted to a pump in which the liquid is sucked into the cylinder during the suction stroke and in which the discharge, or exhaust, port 33 is opened before there is any attempted compression of the liquid so as to discharge the liquid to a sink. Similarly, the exhaust port 33 is closed about the same time as the inlet port 27 is opened to prevent wasting energy creating a vacuum.

In addition, the respective suction and discharge strokes may be controlled more nearly completely indepenently through the use of double ported pistons and double flow areas on the exterior of the piston, such as described hereinafter.

ANOTHER EMBODIMENT EMPLOYING DOUBLE PORTED PISTONS

Figure 8:
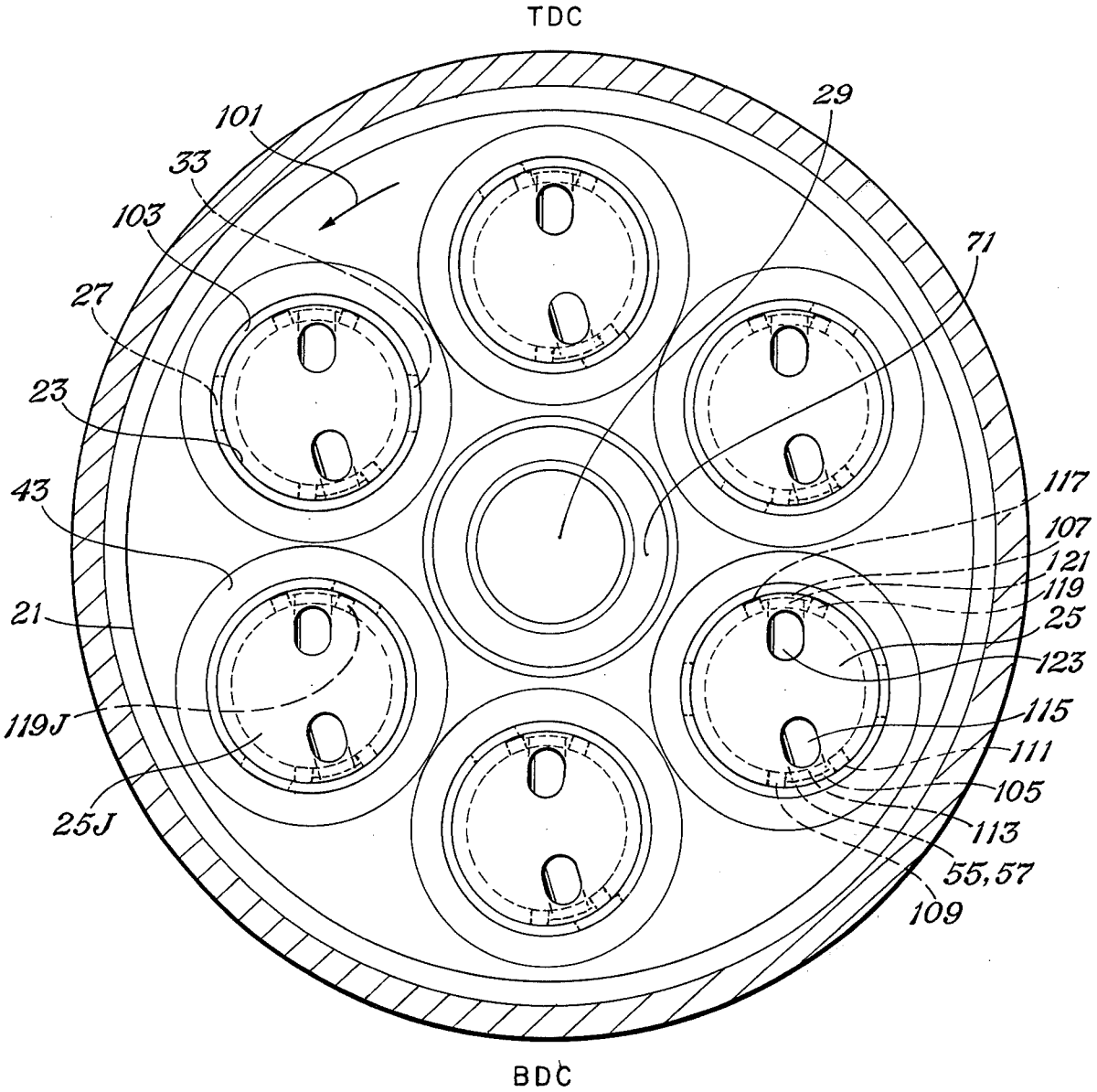
FIG. 8 is a partial end elevational view of a cylinder block and pistons in another embodiment employing dual ported pistons with two flow areas for independently controlling the intake and exhaust strokes of an internal combustion engine or the like for greater flexibility.

As described hereinbefore, the rotary vee device 11 can be employed as an internal combustion engine, either two cycle or four cycle. A particularly preferred embodiment is formed when the pistons are dually ported, as illustrated in FIG. 8. Therein, the cylinder blocks 21 rotate counterclockwise, as indicated by the arrow 101. There are the usual cooling fins 43 on the wall 103 of each cylinder 23. Regardless of whether the wall comprises a single wall or a wall with a sleeve inserted within the cylinder, there is provided the inlet port 27 and the discharge port 33 as described hereinbefore. As described hereinbefore, respective annular passageways communicate, respectively, intermediate the central intake and the annular discharge passageways 29 and 71, and their respective associated inlet and exhaust ports 27 and 33.

In this embodiment, however, each of the pistons 25 have first and second flow areas 105 and 107, analogous to the flow area 35 described hereinbefore. The first flow area 105 is defined intermediate top and bottom peripheral rings 55 and 57 and intermediate longitudinal rings 109 and 111. The first flow area 105 is connected with a second passageway 113, analogous to the second passageway 51 described hereinbefore. The second passageway 113 is connected to a first flow passageway 115, analogous to the first flow passageway 47 described hereinbefore. The first flow area 105 will be employed exclusively for inlet flow, since the exhaust port will never communicate therewith. Expressed otherwise, when the exhaust port is rotated past the correct degrees position, it will be above or below the top and bottom sealing rings 57 and 55 and otherwise outside of the longitudinal rings 109 and 111 such that only the intake port 27 communicates with first flow area 105.

The second flow area 107 is defined intermediate the top and bottom rings 55 and 57, or equivalent rings, and intermediate the longitudinal rings 117 and 119. The second flow area 107 communicates with its own second passageway 121, also referred to herein as the second exhaust passageway. The second exhaust passageway 121 communicates via its respective first flow passageway 123, also referred to herein as the first exhaust flow passageway 123. The second flow area 107 communicates only with exhaust port 33, since the inlet port 27 is either above or below the respective peripheral rings when it passes through the correct degree positions or otherwise outside of the longitudinal rings defining the second flow area. This can be seen more readily in FIG. 9. Therein, the respective first and second flow areas 105 and 107 are illustrated intermediate the respective isolating rings, as described hereinbefore.

The inlet port 27 makes the traverse, or trace, 125; whereas the exhaust port 33 makes the traverse, or trace, 127. Thus, it can be seen that the trace 127 is outside of the first flow area 105 whereas the trace 125 is outside of the second flow area 107. In operation, as the piston moves to the 135° position, shown specifically as the position 129 in FIG. 9, the intake port 27 begins to be opened to communicate with the first flow area 105 and start the suction portion of the cycle. This position is about 45° before bottom dead center, only slightly later in rotation than shown by the piston 25J, FIG. 8. It is noteworthy that the exhaust port 33 is also in communication with the second flow area 107 during the first portion of this intake such that there is scavenging of the spent combustion products by the incoming fresh charge of combustible mixture. In this regard, it is noteworthy that the incoming fresh charge, being more dense, comes in on the radial exterior of the cylinder at the bottom dead center position to force and scavenge the combustion products toward the radial interior and out the exhaust port 33 for greater efficiency. Note at the bottom dead center position the exhaust port will have closed whereas the intake port 27 is still in communication with the first flow area 105, allowing the suction to continue. The intake port 27 is closed by being moved past the vertical seal 111 by 30° after bottom dead center, also indicated by the position 131, FIG. 9, or roughly 210° on the abscissa scale. It is noteworthy that this allows supercharging the pressure during this 30° following closure of the exhaust port 33 and before closure of the inlet port 27. This sort of flexibility is not readilly available in the prior art, particularly in this type of rotary vee engine.

The combustible mixture is compressed as the cylinder and pistons rotate and reciprocate. At an appropriate number of degrees before top dead center the combustible mixture is ignited by suitable firing means, as by a firing plug or the like. The combustible mixture burns, building pressure and imparting power to induce torque by pushing on the angularly related surfaces of the respective pistons 25 and the cylinder heads 22. This continues past top dead center until exhaust port 33 is opened at a position of about 70° before bottom dead center, shown by the position 133 in FIG. 9 and just prior to the position of piston 25J in FIG. 8. The exhaust port is opened by the movement of the vertical seal 119J therepast. Thus, the combustion products at their slightly elevated pressure begin to flow out the exhaust port 33 and the exhaust passageway 71, FIG. 8, before the inlet port opens as described hereinbefore. At about 45° before bottom dead center, the inlet port opens, indicated by the position 129, FIG. 9. As described hereinbefore, at bottom dead center, or the position 135, FIG. 9, the exhaust port 33 closes. Thus, a cycle is repeated for each of the pistons during each rotation of the cylinder block.

From the foregoing descriptive matter, it can be seen that the vertical seal 109 can be moved to vary the opening time $t_o$ of the intake valve, or inlet port 27, while the longitudinal seal 111 is moved to vary the closing time $t_c$ of the inlet port. Analogously, the vertical seal 119 is moved to vary the opening time of the exhaust port 33 and the vertical seal 117 is moved to vary the closing time of the exhaust port, having a given port placement and configuration and given top and bottom rings defining the flow areas.

Volumetric efficienty is improved through the use of protrusions, or rods, that are cantilevered from the head into the first passageway 47 in the piston. Of course, such meshing passageways and rods are located sufficiently close to the center and have enough clearance to prevent twisting off the rod by the relative rotational motion between the head and piston.

SIMPLIFIED EMBODIMENT

A simplified embodiment that has been built and found satisfactory includes the use of timing notches and/or timing protrusions on the crown of the piston. A given timing notch will move axially past a given port, such as an inlet port, on the relative downstroke, but will rotate such that, ordinarily, it will not move past the port on the relative upstroke. This, one notch may be employed for controlling opening timing of a port and another notch, or different position, may be employed for controlling closing timing of the port. The simplified embodiment can be understood by referring to FIGS. 10 and 11.

Therein, the cylinder 23 has its piston 25 disposed reciprocally therewithin, as described hereinbefore. The partial cross sectional view is somewhat schematic in that passageway walls, cooling fins and the like are omitted for simplicity and clarity. The inlet and exhaust ports 27 and 33 penetrate through the sidewalls of the cylinder. A plurality of respective timing notches 137–139 are formed into the crown of the piston. The may be cast or cut thereinto, or otherwise formed as desired. As the timing notch 137 moves relatively downwardly past the inlet port 27, early opening is effected, as compared to the opening that would have been effected by the top 141 of the crown of the piston. Concommitant with further relative downward and upward movement of the piston, there is also rotational movement. Consequently, when the piston passes relatively axially past the inlet port 27, the timing notch 137 will be rotated to position 137A, dashed lines, so it will not affect the closing time of the inlet port. The inlet port will be closed by relative upward passing of the top 141, if no closing timing notch is employed. If a delayed closing is desired, the second timing notch 138 is employed.

With respect to the exhaust port 33, one timing notch 139 is employed. On the relative downstroke, the timing notch 139 effects early opening the exhaust port 33. On the upstroke, however, the relative rotational motion will have positioned the timing notch 139 at the position 139A, dashed lines, so it does not affect closing time of the exhaust port 33. This allows supercharging the cylinder if delayed closing of the inlet port is effected, as by timing notch 138.

The timing notches are sized to obtain the desired timing for given piston and port locations.

Figure 12:
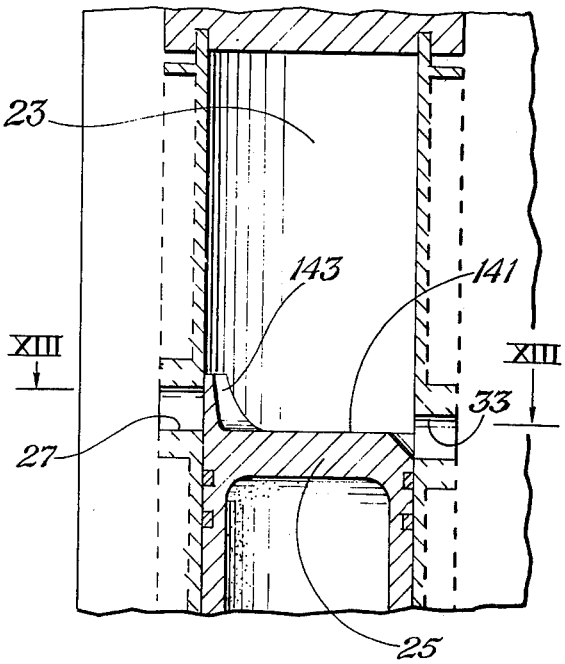
FIG. 12 is a partial cross sectional view illustrating another simplified embodiment employing protrusions, or shoulders, on the piston crown.
Figure 13:
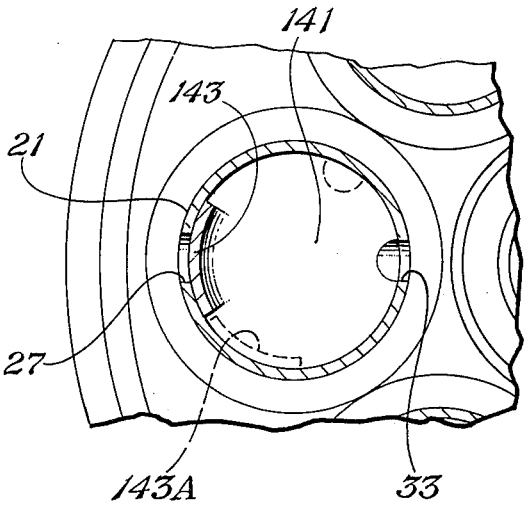
FIG. 13 is a partial end view taken along the lines XIII—XIII of FIG. 12.

Referring to FIGS. 12 and 13, one or more timing protrusions 143 are employed. These one or more timing protrusions can be employed analogously to the timing notches to control the timing of opening and closing of respective ports. As illustrated, the protrusion 143 delays the opening of the inlet port 27 until after the top 141 of the piston 25 has moved relatively therepast.

Figure 10:
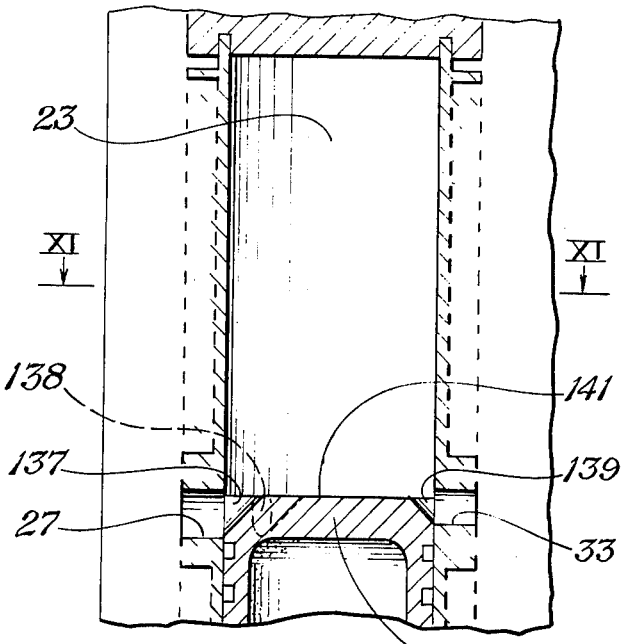
FIG. 10 is a partial cross sectional view illustrating a simplified embodiment; such as, a notched piston crown, as for a two-cycle engine.
Figure 11:
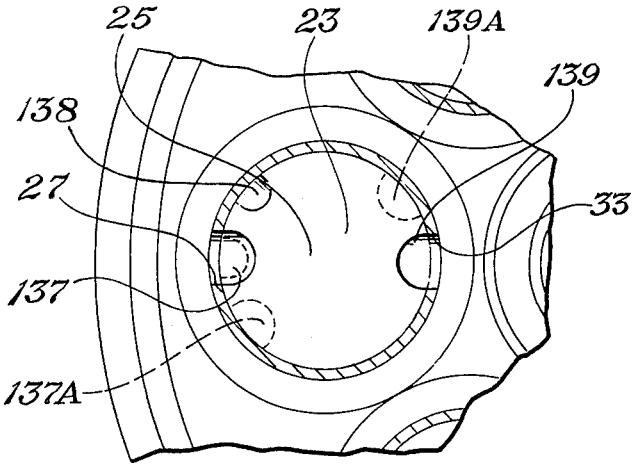
FIG. 11 is a partial end view taken along the lines XI—XI of FIG. 10.

Similarly as described hereinbefore with respect to the timing notch 137, FIGS. 10 and 11, the protrusion 143 will have been rotated to position 143A on the relative upstroke.

Thus, it can be seen that the desired timing is readily effected, as well as altered by the relative angular position and magnitude of timing notches and/or protrusions.

One of the advantages of this invention is that it is widely flexible, yet employs metals and components that are readily available in the prior art, without having to resort to exotic new materials or the like. The peripherally extending rings are readily available and do not need to be described herein. The longitudinal rings may be emplaced in grooves in the peripheral surface of the cylinder, as by being embedded with their ends in sealing engagement with contiguous peripheral rings. If desired, the rings may be made in complete sets and then snapped into position within suitably placed grooves on the pistons.

The cylinders may have sleeves either interiorly or cooling sleeves formed exteriorly thereof. The block, cylinder heads and the like may be formed of any of the conventional means of the prior art.

This invention has been described with respect to employing centrally disposed pistons and cylinder heads and blocks that are disposed at opposite ends and rotate therewith. If desired, the cylinder heads may have the pistons affixed thereto so they protrude interiorly and the compression be done intermediate either ends of oppositely disposed pistons or against a central plate or the like, in what is referred to as an inverted vee engine. The valving may employ the same principle of using the relative rotation between interior walls of a cylinder disposed about the piston and the exterior wall of the piston to effect the valving action by the relative reciprocal and rotational motion between inlet and exhaust ports and respective flow areas, regardless of whether the flow areas are on the piston or on the walls of the cylinder and the inlet and exhaust ports are connected by way of passages through the piston or through the walls of the cylinder.

One advantage of the rotary vee device 11 is that one end may be employed as an internal combustion engine burning, for example, natural gas fuel; and the other end employed as a compressor for compressing the natural gas up to a delivery line pressure; either or both ends employing advantageously the valving system of this invention.

A particular advantage of this invention is that a great flexibility in firing systems can be employed, as described in my issued U.S. Pat. No. 3,830,208. Specifically, spark plugs, glow plugs and the like may be employed to effect firing. On the other hand, the engine may employ the porting of fire from one cylinder to another cylinder or a continuous ring of fire may be employed.

From the foregoing, it will be apparent that this invention provides one or more embodiments that provide one or more of the features delineated hereinbefore as being desirable and not heretofore provided. Specifically, the device provides the flexibility of:

1. allowing pumping by having a structure whereby a discharge can be opened slightly after bottom dead center;

2. allowing compressing the fluid to a line pressure before opening to discharge the fluid into the line if employed as a compressor or the like;

3. allowing valving to control timing for intake and discharge independently of the relative reciprocal position of the piston axially of the cylinder, thereby allowing an additional degree of freedom in design;

4. allowing employing centrifugally assisted scavenging;

5. allowing employing a center section compressor and, if employed as an engine, bypass throttling;

6. allowing opening for discharge of a fluid, later opening for intake, scavenging, closing the discharge and building to supercharge pressures such as has been unable to be accomplished with conventional two cycle porting;

7. allowing flexibility in firing systems that are desired to be employed when employed as an internal combustion engine;

8. allowing being employed as a compressor, as a pump, as a fluid powered motor (such as a hydraulic motor, steam engine or the like) and as an internal combustion engine;

9. allowing a suitable choice and location of inlet and exhaust ports and suitable definition of intake and discharge flow passageways and areas;

10. allowing elimination of the use of cams, cam followers, tappets, valves per se, and eliminate the initial cost and power required to operate the valves, cams, cam followers and the like;

11. allowing elimination of maintenance problems with burned valves in internal combustion engines, breakage of valves in compressors and the like; and 12. Allowing sealing without requiring large diameter seal areas.

Although the invention has been described with a certain degree of particularity, it is understood that the present disclosure is made only by way of example and that numerous changes in the details of construction and the combination and arrangement of parts may be resorted to without departing from the spirit and the scope of this invention.

What is claimed is:

1. In a rotary vee device that includes:

a. a rotational cylinder block having a plurality of cylinders defined therewithin and rotatable about a central longitudinal axis;

b. a plurality of pistons disposed within said cylinders such that there is relative rotational and reciprocal motion between interior walls of said cylinder and the exterior walls of said pistons;

c. a plurality of respective inlet ports and passageways for intake of a fluid within respective cylinders atop respective said pistons therewithin at least by the time said pistons and said cylinders have attained a predetermined first position; said intake ports being connected with and communicating with respective said cylinders at least by said first position;

d. a plurality of respective discharge ports and discharge passageways for discharging fluid from within said cylinder at a predetermined second position; said discharge port being connected with and communicating with respective said cylinders at said second position;

e. power delivery means connected with said device for delivering power with respect thereto;

an improvement comprising:

f. a plurality of respective first flow areas defined on one of the surfaces of said piston and cylinder such that respective ports will traverse thereacross during a revolution of said cylinder block;

g. a plurality of first flow passageways communicating intermediate said first flow area and its said cylinder, at least one for each said cylinder and piston; each said first fluid passageway terminating at a first end in communication with the interior of its respective said cylinder above its respective said piston and at its second end in communication with its respective said first flow area;

h. said respective plurality of intake ports and discharge ports comprising apertures located at predetermined locations on the other of said surface of said cylinder and piston and connected with respective intake and discharge passageways for respective intake and discharge flow of a fluid when a respective port is rotatably and reciprocally brought into communication with its said first flow area;

such that as respective said relative rotational and reciprocal motion is effected between respective said pistons and cylinders an intake flow passage is defined for intake of a fluid interiorly of said cylinder, followed by closure of said intake flow passage, followed by pressurizing of said fluid, followed by opening of a discharge flow passage for discharge of a fluid from the interior of said cylinder, followed by closure of said discharge flow passage to complete a cycle; thereafter repeating said cycle.

2. The device of claim 1 wherein respective said first flow areas are defined on the exterior surfaces of respective said piston respective said first flow passageways traverse through respective said pistons, and said intake ports and discharge ports are located in the interior walls of said cylinders.

3. The improved device of claim 2 wherein each said first flow area is defined on said periphery of each said piston by at least one sealing ring disposed thereon.

4. The improved device of claim 3 wherein each said sealing ring surrounds said piston peripherally.

5. The device of claim 4 wherein each said sealing ring is a diagonally mounted ring.

6. The device of claim 5 wherein each said first flow area is undercut and disposed on the side of said ring opposite from the top of said piston.

7. The device of claim 3 wherein each said first flow area is defined intermediate a plurality of rings on said periphery of said piston, said rings having peripheral and longitudinal components and effecting closure about said area so as to isolate said first flow area.

8. The device of claim 1 wherein said device is an internal combustion engine and each said piston includes a respective intake first flow area, first passageway and first end; and a discharge second flow area, second passageway and second end for individually and independently controlling the intake and discharge operations by suitable location of said flow areas and said intake and discharge ports.

9. The device of claim 8 wherein each said first and second flow areas are defined intermediate a plurality of rings on the periphery of its said piston, said rings having peripheral and longitudinal components and effecting closures at the respective areas so as to isolate, respectively, said first and second flow areas.

10. The device of claim 1 wherein a plurality of inner and removable sleeves are employed interiorly of interior walls of said cylinder; said sleeves having respective fluid flow passageways for effecting a desired sequence of intake and discharge operations.

11. The device of claim 10 wherein said first flow areas and first flow passageways comprise notches formed in the crowns of the respective pistons at predetermined angular positions.

12. In a rotary vee device that includes:

a. a rotational cylinder block having a plurality of cylinders defined therewithin and rotatable about a central longitudinal axis;

b. a plurality of pistons disposed within said cylinders such that there is relative rotational and reciprocal motion between interior walls of said cylinder and the exterior walls of said pistons;

c. a plurality of respective inlet ports and passageways for intake of a fluid within respective cylinders atop respective said pistons therewithin at least by the time said pistons and said cylinders have attained a predetermined first position; said intake ports being connected with and communicating with respective said cylinders at least by said first position;

d. a plurality of respective discharge ports and discharge passageways for discharging fluid from within said cylinder at a predetermined second position; said discharge port being connected with and communicating with respective said cylinders at said second position;

e. power delivery means connected with said device for delivering power with respect thereto;

an improvement comprising:

f. said respective plurality of intake ports and discharge ports comprising apertures located at predetermined locations on one of said surfaces of said cylinder and piston and connected with respective intake and discharge passageways for respective intake and discharge flow of a fluid when rotatably and relatively reciprocally brought into communication with the interior of its said cylinder;

g. structure on the other of said surfaces of said pistons and cylinders that is so designed and located as to effect opening said intake port at a first predetermined axial and rotational position, closing of said intake port at a second predetermined axial and rotational position, opening of said exhaust port at a third predetermined axial and rotational position and closing of said exhaust port at a fourth predetermined axial and rotational position, said rotational positions being adaptable to timing the opening and closing of the respective intake and exhaust ports independently.

13. The device of claim 12 wherein said ports are in said cylinder walls and said structure includes timing notches cut into the respective crowns of said pistons at predetermined angular peripheral positions, a given notch that effects one of early opening and late closing of a given port not also affecting the other of closing and opening time of said port.

14. The device os claim 12 wherein said ports are in said cylinder walls and said structure includes peripheral protrusions upwardly from the crown of said respective pistons at predetermined angular peripheral positions, a given protrusion that effects one of early closing and late opening of a given port not also affecting the other of opening and closing of said port.

* * * * *